United States Patent [19]

Kross et al.

[11] Patent Number: 4,926,719

[45] Date of Patent: May 22, 1990

[54] SUPPLEMENTARY DEVICE FOR INSERTING SCREWS BY MEANS OF A POWER-DRIVEN SCREW DRIVER

[75] Inventors: Manfred Kross, Iserlohn; Hans J. Plumer, Hemer, both of Fed. Rep. of Germany

[73] Assignee: ITW-ATECO, GmbH, Norderstedt, Fed. Rep. of Germany

[21] Appl. No.: 209,893

[22] Filed: Jun. 22, 1988

[30] Foreign Application Priority Data

May 27, 1987 [DE] Fed. Rep. of Germany ..... 3717959

[51] Int. Cl.[5] ..... B25B 13/02

[52] U.S. Cl. ..... 81/57.37; 221/79; 221/25; 81/433

[58] Field of Search ..... 81/57.37, 433, 434; 221/79, 88, 25

[56] References Cited

U.S. PATENT DOCUMENTS

| | | | |
|---|---|---|---|
| 4,018,254 | 4/1977 | DeCaro | 81/57.37 |
| 4,059,034 | 11/1977 | Hornung | 81/57.37 |
| 4,586,405 | 5/1986 | Berecz | 81/57.37 |

*Primary Examiner*—D. S. Meislin

*Attorney, Agent, or Firm*—Schwartz & Weinrieb

[57] ABSTRACT

A supplementary device for driving screws by means of a power-driven screw driver having a driver blade or the like and the device comprising a holding member extending parallel to the driver blade, variable in its length and having a lateral extension, and a magazine disc releasably attached to and rotatably supported upon the lateral extension, the magazine disc being adapted to receive a plurality of screws arranged upon a circular locus, the axis of the driver blade substantially extending through a point of the circular locus and the screws being supported upon the disc such that they can be removed from the disc by means of axial pressure applied thereto by means of the driver blade.

18 Claims, 3 Drawing Sheets

SUPPLEMENTARY DEVICE FOR INSERTING SCREWS BY MEANS OF A POWER-DRIVEN SCREW DRIVER

FIELD OF THE INVENTION

The present invention relates generally to screw-driving apparatus, and more particularly relates to a supplementary device for inserting screws by means of a power-driven screw driver.

BACKGROUND OF THE INVENTION

It is known to insert screws by means of power-driven screw drivers. Conventional screw drivers are designed such that the power thereto is terminated if a predetermined torque is reached. It is further known to associate a device with the screw driver by means of which the screw can be received in an oriented position relative to the driver blade in order to insert the screw at the desired location. In many cases, it is not possible to manually turn the screw or to hold it in a predetermined position prior to the rotation thereof by means of the screw driver. Finally it has become known to provide screw drivers with magazines which receive a plurality of screws and successively feed the individual screws to the driver blade. Relatively short screws encounter problems if they are to be inserted by means of power-driven screw drivers. For example, such screws are used in connection with the manufacture of windows.

OBJECT OF THE INVENTION

The object of the invention is to provide a supplementary device for power-driven screw drivers which is designed to receive a plurality of screws in a magazined state and is suited for the insertion of relatively short screws.

SUMMARY OF THE INVENTION

This object is attained by the features of the present invention wherein the supplementary device according to the invention includes holding means which can be releasably attached to the screw driver, the holding means extending parallel to the driver blade and being designed for changing its length. A magazine disc can be releasably mounted upon a lateral extension of the holding means and is rotatably supported thereon. It receives a plurality of screws. The screws are arranged upon a circular locus, the axis of the driver blade exending through a point of the circular locus. The screws are supported by means of the magazine disc such that they can be removed therefrom as a result of axial pressure applied thereto by means of the driver blade.

Thus, the magazine disc is rotatably supported. Upon a rotation of the magazine disc, the axes of the received screws move upon a circular locus through which the axis of the driver blade extends. If as a result of a predetermined angular position of the magazine a screw is aligned with the driver blade, the retaining means for the screw driver is shortened to such an extent that the driver blade engages the screw or the head slot thereof, respectively. The holding or supporting means is preferably provided with spring means such that in the non-operational position the driver blade is spaced a predetermined distance from the magazine disc. During the driving-in of the screw an axial pressure is continuously exerted upon the screw. By means of this axial pressure, the screw is urged through the magazine disc during the driving-in process. In order to achieve a subsequent screwing operation, the magazine disc is rotated a predetermined angular necessary to align on adjacent screw with the driver blade.

Different structural alternatives are of course possible so as to receive screws by means of a magazine disc so that they can be removed therefrom by means of axial pressure applied thereto. An embodiment of the invention provides a magazine disc having receiving holes for receiving the shanks of the screws, the edges of the receiving holes being yieldable such that the screw heads can be forced through the holes. The hole edges can be weakened in a suitable manner so that they normally hold the screws, however, they yield upon axial pressure being applied to the screw heads in order to pass them therethrough. In order to facilitate this objective, the magazine disc can be made of a suitable flexible material, in particular for example, a plastic material, paper, cardboard or the like. The weakening of the hole edges can be attained, for example, by means of radial cuts.

The support for the magazine disc is defined by means of a lateral extension of the holding means. This extension preferably extends substantially rectangularly and perpendicularly with respect to the axis of the driver blade in order to register the axis of the driver blade with the axis of the screw. It may occasionally be uncomfortable to feed a fresh magazine disc into the support means or to remove an empty disc from the support means, respectively. Therefore, an embodiment of the invention provides for an extension which is linked to the holding means, locking means being provided between the holding means and the extension for locking the extension in a position substantially perpendicular with respect to the axis of the driver blade. In order to remove or feed a magazine disc out from or into the extension, respectively, the extension is pivoted away from the driver blade and, thus, is easily accessible. In order to support the magazine disc, the extension includes a recess which is open toward the holding means.

The magazine disc can be manually operated in order, to align a screw with the driver blade. Such an operation, however, is relatively difficult to accomplish. Therefore, an embodiment of the invention provides for means associated with the magazine disc for indexably rotating the magazine disc in accordance with the angular distance defined between the screw-receiving holes. In accordance with this objective, the magazine disc is provided with indentations, notches or the like along the circumferential peripheral edge thereof. A spring-biased pin or the like cooperates with the indentations such that a locking of the magazine disc is achieved in an angular position whereby the axis of a screw-receiving hole is aligned with respect to the driver blade axis.

As already mentioned, it is preferred to make the magazine disc of a flexible material. The degree of flexibility also depends upon the thickness of the magazine disc. In case the disc is relatively thin, and is made for example of thin paperboard, thick paper or the like, it is occasionally difficult to obtain a satisfactory indexing of the disc and thus a satisfactory operation. Therefore, an embodiment of the invention provides that the magazine disc is releasably, non-displaceably and non-rotatably mounted upon an index disc which has an opening in the vicinity of the receiving holes and is rotatably supported upon the extension. The index disc provides for the rotation of the magazine disc and serves as a seccure support therefor. Preferably, the magazine disc is received within a counterbored recess of the index disc in a predetermined angular orientation.

As already mentioned, the index disc is rotatably supported by means of the extension. This can be achieved for example by forming the extension such that it includes a countersunk recess having at least a partially circular circumferentially extending wall having a radius which corresponds to that of the circular periphery of the index disc, with at least a roller or the like engaging the periphery of the index disc at a predetermined distance from the wall of the recess. Alternatively, a fixed axle can be associated with the index disc or the extension, respectively, for providing rotatable support of the index disc upon the extension.

The index disc according to a further embodiment of the invention may have notches or the like which co-operate with a preferably spring-biased locking pin. A step-by-step rotation of the index disc can thus be achieved in correspondence with the angular distance defined between the screw-receiving holes of the magazine disc. The step-by-step rotation of the disc can automatically by achieved in connection with the return stroke of the driver blade. In order to achieve this operation, a corresponding connection is necessary between the upper and lower portions of the holding means.

BRIEF DESCRIPTION OF THE DRAWINGS

For explanation purposes, the invention will be described hereinafter in connection with the drawings, wherein like reference characters designate like or corresponding parts throughout the several views, and wherein.

DETAILED DESCRIPTION OF THE PREFERRED EMBODIMENT

Figure 1:
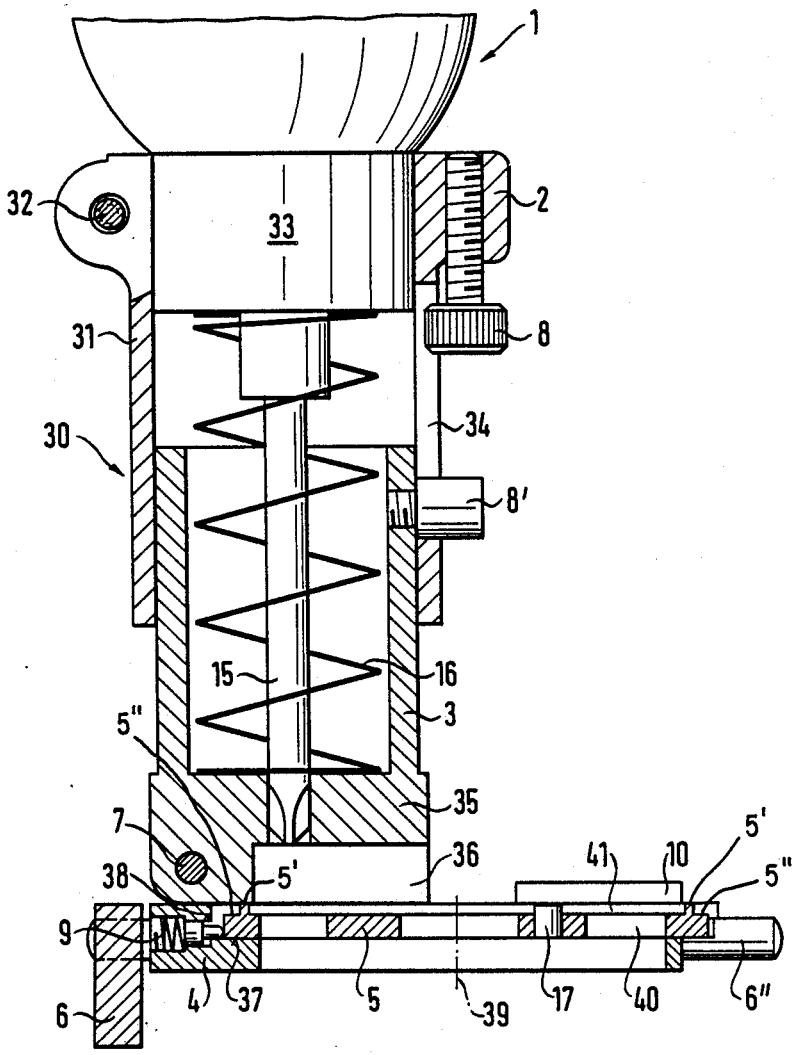
FIG. 1 is a cross section through a supplementary device according to the invention.

Before describing in more detail the individual parts of the invention as illustrated in the drawings, it is to be noted that each of the features of the invention are significant.

A supplementary device 30 is mounted upon a screw driver 1 which is not shown in detail. The supplementary device includes a sleeve 31 clamped upon a cylindrical portion 33 of the screw driver 1. A screw 32 is provided for tightening the sleeve 31 upon the cylindrical portion 33 of the screw driver. A sleeve 3 is slidably displaceable within sleeve 31. The sleeves 31, 3 surround a screw driver blade 15. A spring 16 is positioned within the sleeves 31, 3 and is interposed between cylindrical portion 33 of the screw driver and a bottom end wall of sleeve 3. The sleeve 31 has a slot 34 extending parallel to the axis of the sleeve, a radially outwardly extending projection 8' of sleeve 3 passing through the slot, thus, providing a rotational lock between sleeves 31, 3. The projection 8' also serves as a stops means co-operating with a stop means 8 comprising a screw inserted within a flange portion 2 of sleeve 31. The stop means 8, is thus adjustable.

Figure 2:
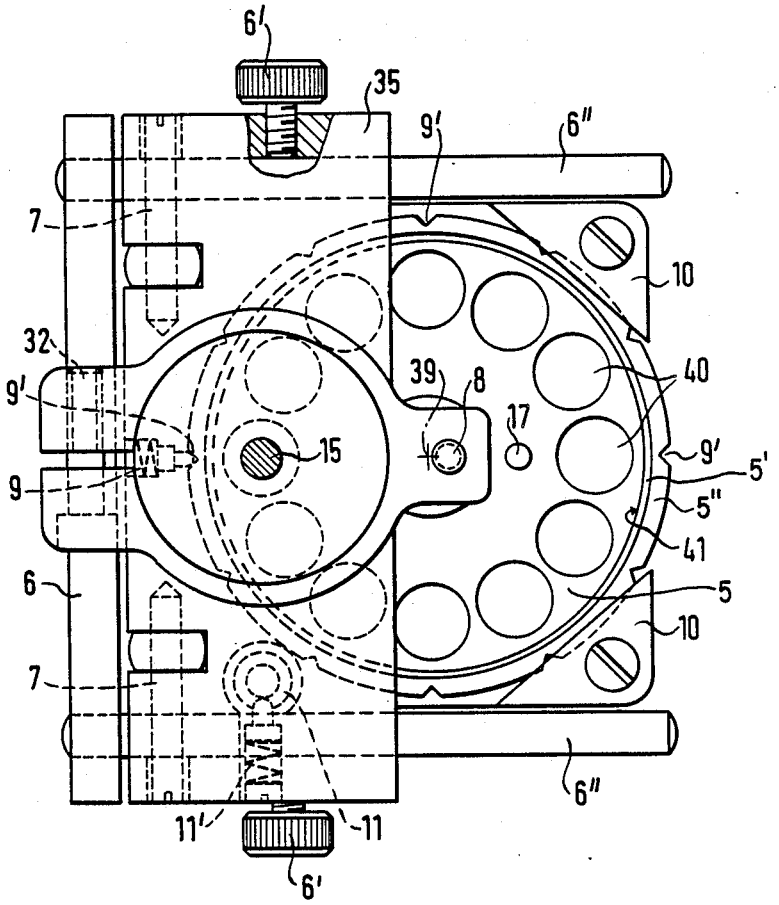
FIG. 2 is a plan view of the device according to FIG. 1.
Figure 3:
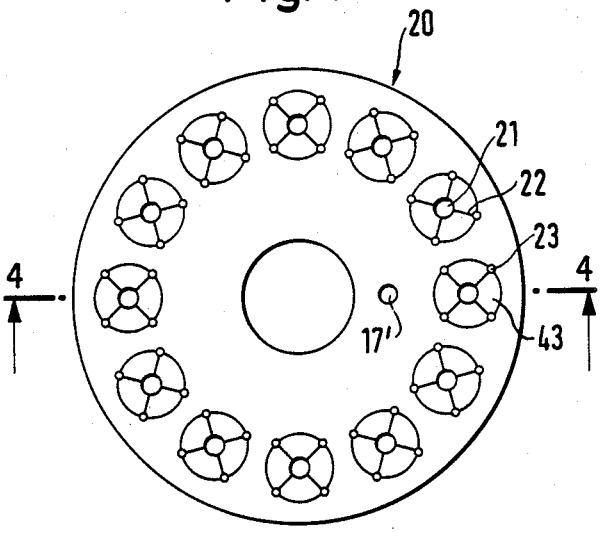
FIG. 3 shows a plan view of a magazine disc for the device according to FIGS. 1 and 2.
Figure 4:
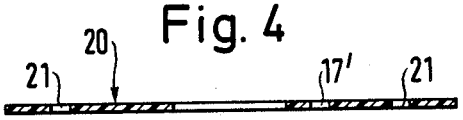
FIG. 4 is a cross section through the magazine disc of FIG. 3 along the line 4—4.

The sleeve 3 is enlarged at the lower end so as to form a plate-like portion. It includes a recess 36 for the passage of the driver blade 15. A plate 4 is pivotally mounted upon plate portion 35 by means of two support pins 7. A spring-biased locking pin 11' is supported by means of plate portion 35, the locking pin 11' co-operating with a pin 11 of plate 4 as shown in FIG. 2 in order to lock plate 4 in the position shown in FIG. 1. The plate 4 can be unlocked by pivoting it manually.

The base plate 4 includes an upwardly open recess 37 having circumferentially extending wall 38 of arc-shaped contour. The recess 37 receives a circular index disc 5. As can be seen in FIG. 2, the index disc 5 is stepped. The upper step 5' has a slightly smaller diameter than the lower step 5'' which is provided with circumferentially spaced notches 9'. As can be seen, the upper step 5' co-operates with rollers corrugated at the circumference thereof, the rollers being located beneath portions 10 extending partially over the lower step 5'' of the disc 5 and engaging a corrugated circumference of the upper step 5' of the index disc 5. By means of the circular wall 38 and the not shown rollers, rotatable movement of the index disc 5 about the axis 39 is achieved (FIG. 1). The portions 10 as seen in FIG. 2 partially overlap the lower step 5'' of discs 5, however, they do not contact the upper step 5'. The index disc 5 includes a plurality of circular throughbores 40 and a pin 17 extending upwardly within a circular countersunk recess 41 defined within the upper surface of the index disc 5. A spring-biased detent pin 9 is mounted upon plate 4 for co-operating with the notches 9' of disc 5. The notches 9' are arranged such that a throughbore 40 is aligned with the axis of the screw driver blade 15 when the detent pin 9 engages one of the notches 9'.

An abutment plate 6 is connected to two rods 6'' which are slidably mounted relative to plate 4. Set screws 6' of plate 4 co-operate with the rods 6'' serves so that the latch 6 as a lateral stop so that the plate 4 and its axis 39 can be disposed a predetermined distance from the axis of the driver blade 15.

Figure 5:
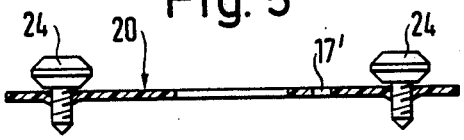
FIG. 5 is a cross-section of the magazine disc of FIG. 4 inclusive of screws.
Figure 6:
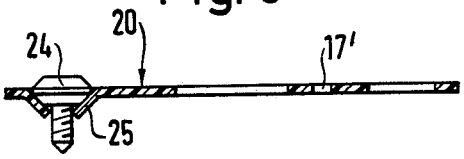
FIG. 6 is an illustration similar to that of FIG. 5, however, with a partially ejected screw.

In the FIGS. 3 to 6, a magazine disc 20 is shown having a circular form and can be mounted within the recess 41 of the index disc 5. The magazine 20 includes an eccentric opening 17' through which the positioning pin 17 of the index disc 5 will extend when the magazine disc 20 is disposed upon the index disc 5. The index disc 20 is provided with bores 21, the axes thereof being located upon a circular locus which is aligned with the circular locus of the axes of the throughbores 40. Furthermore, the circumferential distance defined between the bores 21 is equal to the circumferential distance defined between the through-bores 40. Positioning pin 17 and opening 17' co-operate such that the bores 21 are precisely aligned with the axes of the throughbores 40. Four radial slits extend from the bores 21 which terminate in smaller bores 23. The material of the magazine disc 20 is relatively flexible and for example consists of paper, paperboard, plastic or the like. As a result of such structure, the slits or cuts defined flexible sectors 43. The bores 21 receive screws 24 which have a very short shank and in relation thereo a large head (see FIG. 5). The cuts or slits are dimensioned such that a screw can be ejected from the magazine disc by means of axial pressure applied thereto by means of the screw driver 1 as shown in FIG. 6 at 25.

The device described is operated as follows. A filled magazine disc 20 according to FIG. 5 is inserted within the index disc 5 when plate 4 is pivoted downwardly with respect to sleeve 3. Positioning pin 17 and positioning opening 17' serve for the accurate location of the magazine disc 20 within the recess 41 of index disc 5. Due to the co-operation of the spring-biased pin 9 and a notch 9' of the index disc 5, the index disc 5 is disposed at a correct position relative to the driver blade 15. If pressure is now exerted by means of the screw driver 1 toward the base plate 4 upon engagement of the base plate with a work-piece, the sleeves 31, 3 telescopically move with respect to each other against the pressure of spring 16 so that the driver blade 15 co-operates with the screw head. The screw is turned and leaves the magazine disc 20, that is it is ejected out of the disc as can be seen in FIG. 6. When the screw is completely screwed into the workpiece, the stop means 8, 8' come into engagement. Therefore, substantially no additional torque is exerted upon the screw because the screwdriver is unable to undergo any substantially additional axial movement. The screw driver is retracted, and the index disc 5 is now manually turned a predetermined angular amount until the engagement of pin 9 with an adjacent notch 9'. An additional inserting operation can now commence. The latch 6 serves to insure that the axis of the driver blade 15 remains at a predetermined distance from the edge of the workpiece.

It is still to be noted that in contrast to the indexing of index disc 5 by hand, such an operation can be carried out automatically in that the stroke motion of sleeve 3 can be coupled by means of a linkage or the like to disc 5 enabling a driving of the index disc 5 a predetermined amount determined by the distance defined between the throughbores 40.

Instead of the magazine disc 20 a magazine strip can be used which is also indexed and which receives screws within holes such that they can be urged therethrough.

Obviously, many modifications and variations of the present invention are possible in light of the above teachings. It is therefore to be understood that within the scope of the appended claims, the present invention may be practiced otherwise than as specifically described herein.

We claim:

1. A supplementary device for driving fasteners by means of a tool having a longitudinal axis, comprising:

means coaxially disposed with respect to said tool for movably supporting said tool between a first retracted non-driving position with respect to said fasteners at which said tool is out of engagement with said fasteners, and a second extended driving position with respect to said fasteners at which said tool is disposed in engagement with one of said fasteners so as to drive said one of said fasteners into a workpiece;

a base plate mounted upon said tool supporting means so as to extend substantially perpendicular with respect to said longitudinal axis of said tool supporting means and said tool;

index disc means removably mounted and rotatably indexable upon said base plate for supporting said fasteners at a plurality of loci which define a circular arc which intersects said longitudinal axis of said tool wherein each one of said fasteners disposed along said cricular arc can be coaxially disposed with said tool along said longitudinal axis thereof as said index disc means is indexed upon said base plate such that said tool can engage said one of said fasteners disposed at an arcuate position corresponding to said longitudinal axis of said tool when said tool is moved from said first retracted position to said second extended driving position so as to drive said one of said fasteners into said workpiece during performance of a fastener driving operation; and magazine disc means releasably supporting said fasteners upon said index disc means for permitting said fasteners to be released from said magazine disc means and said index disc means as a result of axial pressure applied to said one of said fasteners, disposed at said arcuate position corresponding to said longitudinal axis of said tool, by said tool as said tool engages said one of said fasteners as a result of being moved from said first retracted position to said second extended driving position during performance of said fastener driving operation.

2. The device as set forth in claim 1, wherein:

said fasteners comprise screws; and said tool comprises a screw driver.

3. The device according to claim 2, wherein the magazine disc means includes receiving holes for the shanks of said screws and wherein the edge of said receiving holes is resilient such that the screw head is urgible through said hole.

4. The device according to claim 3, wherein the magazine disc means is made of flexible material chosen from a group of materials comprising plastics material, paper, and paperboard, and wherein radial cuts extend from said receiving holes.

5. The device according to claim 4, wherein bores are provided at the radially outer ends of said cuts.

6. The device according to claim 1, wherein said base plate includes a recess open towards said tool supporting means for supporting said index disc means.

7. The device according to claim 1, wherein the index disc means includes means for indexing said index disc means at the angular spacing of said fastener loci.

8. The device according to claim 1, wherein:

said index disc means comprises an index disc, which has openings defined therein and through which said fasteners can be moved when driven into said workpiece, rotatably indexable upon said base plate; and said magazine disc means is releasably, non-displaceably, and non-rotatably mounted upon said index disc for supporting said fasteners at said plurality of loci.

9. The device according to claim 8, wherein the magazine disc means is received within a recess of said index disc at a predetermined angular orientation.

10. The device according to claim 9, wherein said index disc has at its periphery notches which co-operate with a spring-biased locking pin mounted upon said base plate.

11. The device according to claim 10, wherein said tool supporting means comprises two telescopically displaceable portions, including an upper portion releasably connected to said tool comprising a screw driver, and a lower portion connected to said base plate, with a spring being provided between said portions.

12. The device according to claim 11, wherein the portions include co-operating abutments one of which is adjustable for limiting the movement of said tool between said first and second positions.

13. The device according to claim 8, wherein said index disc has at its periphery notches which co-operate with a spring-biased locking pin mounted upon said base plate.

14. The device according to claim 2, wherein said tool supporting means comprises two telescopically displaceable portions, including an upper portion releasably connected to said screw driver and a lower portion connected to said base plate with a spring being provided between said portions.

15. The device according to claim 14, wherein the portions are sleeves.

16. The device according to claim 14, wherein the portions include co-operating abutments one of which is adjustable for limiting the movement of said tool between said first and second positions.

17. The device as set forth in claim 1, wherein:

said base plate is pivotably mounted upon said tool supporting means between a first open position at which said index disc means can be loaded upon or removed from said base plate, and a second closed position at which said base plate, and said index disc means, extend substantially perpendicular to said longitudinal axis of said tool supporting means and said tool so as to be disposed at an operative position with respect to said tool during said fastener driving operation; and latch means provided upon said base plate and said tool supporting means for latching said base plate at said second closed position relative to said tool supporting means.

18. The device as set forth in claim 17, wherein said latch means comprises:

a first pin disposed upon said base plate; and a locking pin disposed within said tool supporting means for engaging said first pin of said base plate.

* * * * *